US008516984B2

(12) United States Patent
Schwoerer

(10) Patent No.: US 8,516,984 B2
(45) Date of Patent: Aug. 27, 2013

(54) LOST MOTION VARIABLE VALVE ACTUATION SYSTEM WITH VALVE CATCH PISTON

(75) Inventor: John A. Schwoerer, Storrs, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 217 days.

(21) Appl. No.: 12/852,115

(22) Filed: Aug. 6, 2010

(65) Prior Publication Data

US 2011/0067661 A1 Mar. 24, 2011

Related U.S. Application Data

(60) Provisional application No. 61/232,296, filed on Aug. 7, 2009.

(51) Int. Cl.
*F01L 1/18* (2006.01)

(52) U.S. Cl.
USPC ..... 123/90.44

(58) Field of Classification Search
USPC ..... 123/90.44, 90.48, 90.52, 90.16
See application file for complete search history.

(56) References Cited

U.S. PATENT DOCUMENTS 4,463,714 A * 8/1984 Nakamura ..... 123/90.57
4,796,573 A 1/1989 Wakeman et al.
6,302,370 B1 10/2001 Schwoerer et al.
6,769,385 B1 8/2004 Chang
7,464,678 B2 * 12/2008 Rozario et al. ..... 123/90.52
2005/0132986 A1 6/2005 Chang

FOREIGN PATENT DOCUMENTS

GB 564507 10/1944
GB 1063499 3/1967

OTHER PUBLICATIONS

Hope A. Bolton and Jay M. Larson, Valvetrain System Design and Materials, "A Chronology of Hydraulic Lash Compensation in the United States" by W.A. Dammers (Eaton Corporation, Marshall, Michigan), International Symposium on Valvetrain System Design and Materials, Apr. 14-15, 1997, pp. 27-41, ASM International, Materials Park, Ohio, United States of America.

* cited by examiner

*Primary Examiner* — Zelalem Eshete
(74) *Attorney, Agent, or Firm* — Kelley Drye & Warren, LLP

(57) ABSTRACT

Hydraulic lost motion systems and methods for actuating an internal combustion engine valve include a master piston slidably disposed in a housing. One or more master piston fluid passages extend from a bore provided in the master piston and register with a fluid passage extending through the housing. A slave piston is slidably disposed in a lower portion of the master piston bore and a valve catch piston is slidably disposed in an upper portion of the master piston bore. The valve catch piston may have a hollow interior, a lower end orifice extending from the hollow interior through a lower end of the valve catch piston, one or more side passages extending through a side portion of the valve catch piston, and one or more seating passages extending through the valve catch piston wall.

18 Claims, 3 Drawing Sheets

LOST MOTION VARIABLE VALVE ACTUATION SYSTEM WITH VALVE CATCH PISTON

CROSS-REFERENCE TO RELATED APPLICATIONS

The present application relates to, and claims the priority of, U.S. Provisional Patent Application Ser. No. 61/232,296, filed Aug. 7, 2009, which is entitled "Lost Motion Variable Valve Actuation System With Valve Catch Piston."

FIELD OF THE INVENTION

The present invention relates generally to a system for actuating one or more engine valves in an internal combustion engine. In particular, the invention relates to systems and methods for controlling valve seating velocity.

BACKGROUND OF THE INVENTION

Internal combustion engines typically use either a mechanical, electrical or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

Hydraulic lost motion valve actuation systems may be driven with a cam, particularly those used for an internal combustion engine. The hydraulic displacement of an engine valve in such a lost motion system is directly proportional to the displacement provided by the cam during normal operation. In some applications, however, the engine valve must be closed at an earlier time than that provided by the cam profile. This earlier closing may be carried out by rapidly releasing hydraulic fluid to an accumulator in the lost motion system or to the oil sump. In such instances engine valve seating control may be required because the rate of closing the valve is governed by the hydraulic flow to the accumulator or sump instead of by the fixed cam profile. Engine valve seating control may also be required for applications (e.g. centered lift) in which the engine valve seating occurs on a high velocity region of the cam. Still further, engine valve seating control may be required in common rail Variable Valve Actuation (VVA) designs, in which all seating events occur as a result of the release of hydraulic fluid, possibly to an accumulator.

An example of known systems and methods for controlling valve seating velocity are disclosed in U.S. Pat. No. 6,302,370 to Schwoerer et al., which is hereby incorporated by reference.

It is an advantage of some, but not necessarily all, embodiments of the present invention to provide methods and systems for seating an engine valve using hydraulically actuated components.

SUMMARY OF THE INVENTION

Responsive to the need for systems and methods for controlling valve seating velocity, Applicant has developed an innovative hydraulic lost motion system for actuating an internal combustion engine valve comprising: a housing having a housing bore extending through the housing; a housing fluid passage extending through the housing and connecting with the housing bore; a master piston disposed in the housing bore, said master piston having a master piston bore extending into the master piston defined by a master piston side wall; one or more master piston fluid passages extending through the master piston side wall and connecting with the master piston bore, wherein the one or more master piston fluid passages are adapted to selectively register with the housing fluid passage; a slave piston disposed in a lower portion of the master piston bore; a valve catch piston disposed in an upper portion of the master piston bore, said valve catch piston having a hollow interior defined by a valve catch piston wall, a lower end orifice extending from the hollow interior through a lower end of the valve catch piston wall, one or more side passages extending through a side portion of the valve catch piston wall, and one or more seating passages extending through the valve catch piston wall, wherein the lower end orifice is located so as to be selectively occluded by the slave piston, the one or more side passages are located so that hydraulic fluid communication between the one or more side passages and the one or more master piston fluid passages is selectively occluded by the master piston side wall, and the one or more seating passages are located so as to remain in hydraulic communication with the one or more master piston fluid passages; and a valve catch spring disposed in the valve catch piston hollow interior.

Applicant has further developed an innovative hydraulic lost motion system for actuating an internal combustion engine valve as set forth above in paragraph 0006 wherein the master piston bore includes an upper master piston bore in which the valve catch piston is disposed and a lower master piston bore in which the slave piston is disposed, and wherein a diameter of the lower piston master piston bore is greater than a diameter of the upper master piston bore.

Applicant has further developed an innovative hydraulic lost motion system for actuating an internal combustion engine valve as set forth above in paragraph 0006 further comprising a slave piston spring disposed between the housing and the slave piston, said slave piston spring biasing the slave piston away from the housing.

Applicant has further developed an innovative hydraulic lost motion system for actuating an internal combustion engine valve as set forth above in paragraph 0006 wherein the one or more seating passages extend from the valve catch piston hollow interior through the valve catch piston side wall.

Applicant has further developed an innovative hydraulic lost motion system for actuating an internal combustion engine valve as set forth above in paragraph 0006 wherein at least one of the one or more seating passages extend from at least one of the one or more side passages through the lower end of the valve catch piston wall.

Applicant has further developed an innovative hydraulic lost motion system for actuating an internal combustion engine valve as set forth above in paragraph 0006 wherein the one or more master piston fluid passages include a lower master piston fluid passage and an upper master piston fluid passage, and wherein the valve catch piston wall forms a valve catch piston shoulder adapted to occlude hydraulic fluid communication between the one or more side passages and the upper master piston fluid passage.

Applicant has further developed an innovative hydraulic lost motion system for actuating an internal combustion engine valve as set forth above in paragraph 0011 wherein the one or more master piston fluid passages includes a mid master piston fluid passage disposed along the master piston side wall between the lower master piston fluid passage and the upper master piston fluid passage.

Applicant has further developed an innovative hydraulic lost motion system for actuating an internal combustion engine valve as set forth above in paragraph 0006 further comprising a hydraulic fluid control valve in hydraulic communication with the housing fluid passage.

Applicant has further developed an innovative hydraulic lost motion system for actuating an internal combustion engine valve as set forth above in paragraph 0006 further comprising a hydraulic fluid accumulator in hydraulic communication with the hydraulic fluid valve.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Figure 1:
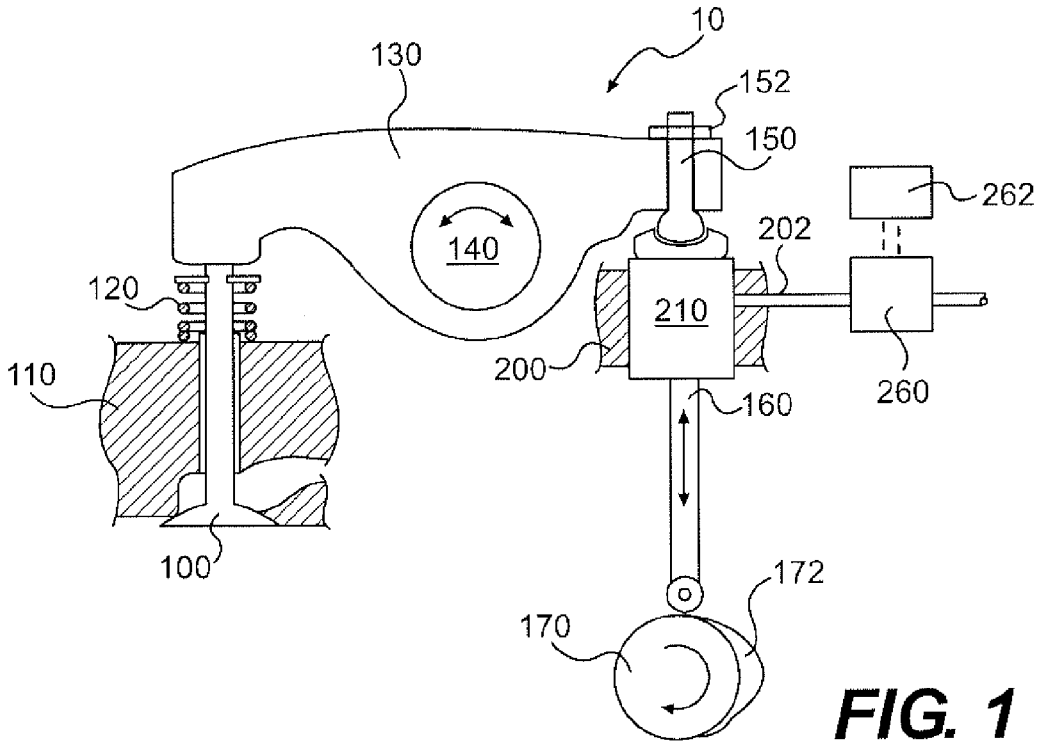
FIG. 1 is a schematic diagram illustrating a first valve actuation system in which an embodiment of the present invention may be used.

Reference will now be made in detail to embodiments of the present invention, examples of which are illustrated in the accompanying drawings. With reference to FIG. 1, a first engine valve actuation system 10 is shown in which the hydraulic lost motion systems 210 constructed in accordance with embodiments of the present invention may be used. The engine valve actuation system 10 may include an engine valve 100, such as an exhaust, intake or auxiliary engine valve, which is slidably disposed in an engine valve head 110. The engine valve 100 may be biased by one or more valve springs 120 into a closed position, as shown.

A rocker arm 130 may be pivotally mounted on a rocker shaft 140 adjacent to the engine valve 100. The rocker arm 130 may have a first end in contact with the upper end or stem of the engine valve 100 and a second end having an elephant foot assembly 150. The elephant foot assembly 150 may include a nut 152 which permits the position of the elephant foot assembly to be adjusted relative to the rocker arm 130. The elephant foot assembly 150 may permit the rocker arm 130 to receive linear motion from a hydraulic lost motion system 210 used to pivot the rocker arm.

The hydraulic lost motion system 210 may be slidably disposed in a lost motion system housing 200 and may have an end in contact with the elephant foot assembly 150. The end of the lost motion system 210 which is opposite from the end in contact with the elephant foot assembly 150 (i.e., the lower end in FIG. 1) may be in contact with a push tube 160, which in turn may be in contact with a cam 170. The cam 170 may include one or more lobes or bumps 172 which impart motion to the push tube 160 and lost motion system 210. The bumps 172 may provide one or more intake valve actuations or one or more exhaust valve actuations, such as engine braking and exhaust gas recirculation motions, for example.

The lost motion system 210 may be in hydraulic fluid communication with a hydraulic fluid valve 260, such as a high-speed trigger valve, via a housing fluid passage 202. If the hydraulic fluid valve 260 is a high-speed trigger valve, it may be capable of being opened and closed at least once per engine cycle. Hydraulic fluid may be provided to, and released from, the lost motion system 210 under the control of the hydraulic fluid valve 260. The fluid passage 202 may also be directly or indirectly in hydraulic fluid communication with a hydraulic fluid accumulator 262 in an alternative embodiment of the present invention. The accumulator 262 may be used to rapidly receive hydraulic fluid vented from the lost motion system 210 by the hydraulic fluid valve 260, as well as to rapidly refill the lost motion system 210 with hydraulic fluid under the control of the hydraulic fluid valve 260.

Figure 2:
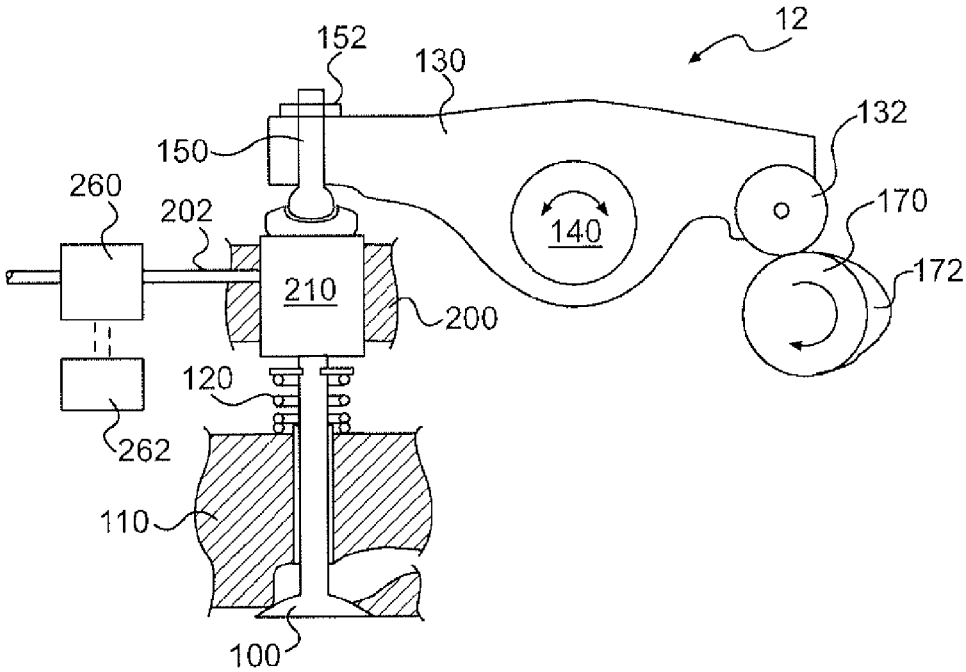
FIG. 2 is a schematic diagram illustrating a second valve actuation system in which an embodiment of the present invention may be used.

With reference to FIG. 2, a second engine valve actuation system 12 is shown in which a hydraulic lost motion system 210 in accordance with an embodiment of the present invention may be used. The engine valve actuation system 12 may include an engine valve 100, such as an exhaust, intake or auxiliary engine valve, slidably disposed in an engine valve head 110. The engine valve 100 may be biased by one or more valve springs 120 into a closed position, as shown.

A lost motion system 210 may be slidably disposed in a lost motion system housing 200 adjacent to and in contact with the upper end or stem of the engine valve 100. The lost motion system 210 may have an end (i.e., the upper end in FIG. 2) in contact with an elephant foot assembly 150. The elephant foot assembly 150 may be adjustably mounted in the first end of a rocker arm 130 and may be locked into position by a nut 152.

The rocker arm 130 may be pivotally mounted on a rocker shaft 140 adjacent to the lost motion system 210 so as to be able to impart linear motion to the lost motion system 210. The rocker arm 130 may have a cam roller 132 mounted on a second end of the rocker arm and in contact with a cam 170. The cam 170 may include one or more lobes or bumps 172 which impart motion to the rocker arm 130 and lost motion system 210. The bumps 172 may provide one or more intake valve actuations or one or more exhaust valve actuations, such as engine braking and exhaust gas recirculation motions, for example.

The lost motion system 210 may be in hydraulic fluid communication with a hydraulic fluid valve 260, such as a high-speed trigger valve, via a housing fluid passage 202. If the hydraulic fluid valve 260 is a high-speed trigger valve, it may be capable of being opened and closed at least once per engine cycle. Hydraulic fluid may be provided to, and released from, the lost motion system 210 under the control of the hydraulic fluid valve 260. The housing fluid passage 202 may also be directly or indirectly in hydraulic fluid communication with a hydraulic fluid accumulator 262 in an alternative embodiment of the present invention. The accumulator 262 may be used to rapidly receive hydraulic fluid vented from the lost motion system 210 by the hydraulic fluid valve 260, as well as to rapidly refill the lost motion system 210 with hydraulic fluid under the control of the hydraulic fluid valve 260.

With reference to FIGS. 1 and 2, it is appreciated that variations to the systems 10 and 12 may be made without departing from the intended scope of the invention. For example, in an alternative embodiment of the invention, the rocker arm 130 or the lost motion system 210 may contact the engine valve(s) 100 through a valve bridge (not shown) or other intervening valve train element. Further, the cam 170 may act directly on the lost motion system 210 instead of through an intervening push tube 160 and/or rocker arm 130 with respect to FIG. 1, and the cam 170 may act on the rocker arm 130 through a push tube with respect to FIG. 2.

Figure 3:
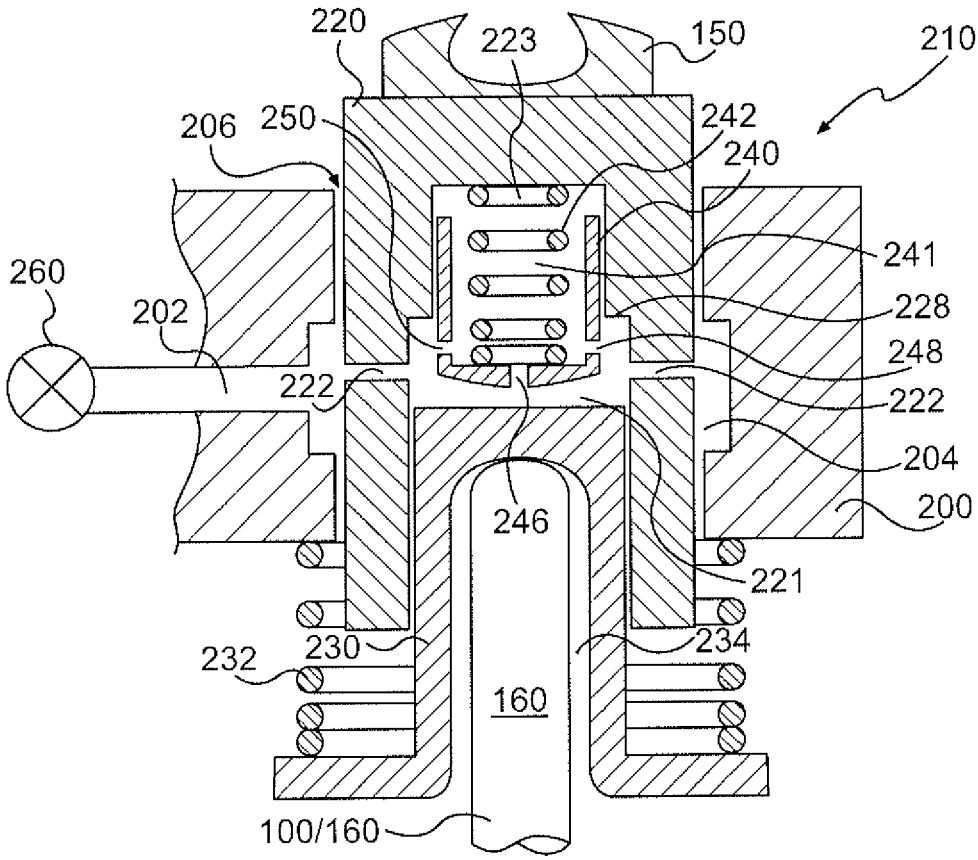
FIG. 3 is a side view in cross-section of a hydraulic lost motion system in accordance with a first embodiment of the present invention.

Reference will now be made to a first embodiment of the lost motion system 210, shown in FIG. 3, which may be used with the valve actuation systems 10 and 12, and variations thereof, illustrated in FIGS. 1 and 2. With reference to FIG. 3, the lost motion system 210 may include a master piston 220 which is slidably disposed in a housing bore 206 provided in the lost motion system housing 200. The master piston 220 is shown to be in contact with the elephant foot assembly 150 at the upper end of the master piston. It is appreciated that in alternative embodiments, however, the master piston 220 may be in contact with a cam 170 or a rocker arm 130, directly. The master piston 220 may have a hollow interior comprised of an upper master piston bore 223 and lower master piston bore 221. The upper master piston bore 223 may have a smaller diameter than the lower master piston bore 221 in a preferred embodiment such that the intersection of the upper master piston bore 223 and the lower master piston bore 221 form a master piston shoulder 228. The upper master piston bore 223 is also referred to herein as a valve catch plenum and the lower master piston bore 221 is also referred to herein as a tappet plenum.

The master piston 220 may include one or more master piston fluid passages 222 extending from the tappet plenum 221 to the exterior of the master piston. The master piston fluid passages 222 may be located along the side wall of the master piston 220 so as to register with an annular recess 204 provided in the housing 200 as part of the housing fluid passage 202. The annular recess 204 may be sized so as to remain in hydraulic communication with the hydraulic fluid valve 260 and the one or more master piston fluid passages 222 throughout the stroke of the master piston 220.

A slave piston 230 may be slidably disposed in the tappet plenum 221. The slave piston 221 may biased by one or more springs 232 into a contact with a push tube 160 (as shown in FIG. 1) or into contact with an engine valve 100 (as shown in FIG. 2). It is appreciated that in alternative embodiments, the slave piston 230 may be biased towards or into contact with a valve bridge (not shown). The slave piston 230 may include a slave piston recess 234 for receiving a valve 100 stem or push tube 160. The slave piston 230 may have an upper surface adapted to seal a lower end orifice 246 provided in a valve catch piston 240.

With continued reference to FIG. 3, the lost motion system 210 may further include a valve catch piston 240 slidably disposed in the valve catch plenum 223. The valve catch piston 240 may include a hollow interior 241 in which a valve catch spring 242 may be disposed. The valve catch spring 242 may bias the valve catch piston 240 towards the slave piston 230. The valve catch piston 240 may include a lower end which is slightly convex shaped and a lower end orifice 246 extending from the hollow interior 241 through the valve catch piston wall. The lower end orifice 246 is preferably sized to be selectively blocked or occluded by the slave piston 230 when the slave piston and the valve catch piston 240 are in contact with each other. The valve catch piston may further include one or more side passages 248 and one or more seating passages 250. Both the side passages 248 and the seating passages 250 may extend through the side wall of the valve catch piston 240. The one or more side passages 248 may be located further from the lower end of the valve catch piston lower wall than the one or more seating passages 250, or in other words, the one or more seating passages 250 may be located lower along the side wall of the valve catch piston 240 than the one or more side passages 248. The side passages 248 may be located so as to be selectively occluded by the master piston shoulder 228 as a result of the valve catch piston 240 sliding in the valve catch plenum 223. The one or more seating passages 250 may be located so as to remain unoccluded by the master piston 220 and more specifically by the master piston shoulder 228 as a result of the valve catch piston 240 sliding in the valve catch plenum 223. The one or more seating passages 250 may be sized so as to permit a selective amount of hydraulic fluid to vent through them to seat the engine valve 100 after the one or more side passages 248 and the lower end orifice 246 are blocked.

The lost motion system 210 shown in FIG. 3 may be used to actuate and seat an engine valve, such as shown in FIGS. 1 and 2, as follows. With reference to FIGS. 1-3, the hydraulic fluid valve 260 may be opened when the cam 170 is on base circle (i.e., when the cam 170 does not have a bump 172 in contact with a valve train element such as the push tube 160 or rocker arm 130) to fill the system 10 or 12 with hydraulic fluid. As a result of the cam 170 being on base circle, low pressure (e.g., less than 100 psi) hydraulic fluid from a hydraulic fluid supply (not shown) and potentially from an accumulator 262, may flow from the hydraulic fluid valve 260 into the lost motion system 210, and more specifically, through the housing fluid passage 202, the annular recess 204, and the master piston fluid passage 222, into the tappet plenum 221. The hydraulic fluid may fill the valve catch plenum 223 through the one or more seating and side passages 248 and 250 and the lower end orifice 246. The valve catch spring 242 may cause the valve catch piston 240 to slide downward into the tappet plenum 221. The slave piston 230 may also slide downward in the tappet plenum 221 as a result of the introduction of hydraulic fluid into the lost motion system 210 by the hydraulic fluid valve 260.

Once the hydraulic lost motion system 210 is charged with hydraulic fluid, the hydraulic fluid valve 260 may be closed so that the separation of the master piston 220 from the slave piston 230 is maintain due to the tappet plenum 221 being hydraulically sealed. Thereafter motion imparted from the cam 170 to the lost motion system may be transferred from the master piston 220 to the slave piston 230, and in turn to the engine valve 100. In order to terminate the actuation of the engine valve 100 before the time prescribed by the one or more bumps 172 on the cam 170, the hydraulic fluid valve 260 may be selectively opened. When the hydraulic fluid valve 260 is opened, hydraulic fluid may escape from the lost motion system 210 past the hydraulic fluid valve 260 to the low pressure fluid supply (not shown) and/or potentially to an accumulator 262.

When the hydraulic fluid valve 260 is opened, the engine valve springs 110 may push the engine valve 100 upward which in turn may cause the slave piston 230 to be pushed into the fluid in the tappet plenum 221. The fluid in the tappet plenum 221 may be displaced and flow out of the lost motion system 210 through the one or more master piston fluid passages 222 and the housing fluid passage 202. As the fluid vents through the housing fluid passage 202, the slave piston 230 may slide into the tappet plenum 221 relatively rapidly until it contacts the valve catch piston 240 at which time the slave piston upper surface may occlude the lower end orifice 246. As fluid continues to vent through the housing fluid passage 202, the valve catch piston 240 may be pushed upward into the valve catch plenum 223 against the bias force of the valve catch spring 242. As the valve catch piston 240 is pushed upwards fluid in the valve catch piston plenum 223 must vent through the one or more side passages 248 and the one or more seating passages 250. The rate at which the engine valve 100, the slave piston 230, and the valve piston 240 move upward (i.e., the engine valve seating velocity) may be decreased relative to the initial engine valve seating velocity because the valve catch plenum 223 must vent through the one or more side passages 248 and the one or more seating passages 250 in order for the valve catch piston 240 to move upward. As the valve catch piston continues to move upward, the engine valve seating velocity may be further reduced as the one or more side passages 248 are occluded by the master piston shoulder 228. The occlusion of the one or more side passages 248 may prevent fluid from escaping from the valve catch plenum 223 through the side passages, and may force any additional venting of fluid from the valve catch plenum 223 to occur through the one or more seating passages 250 which remain unblocked or un-occluded by the master piston shoulder 228 throughout the stroke of the valve catch piston 240. The seating passages 250 may be selectively sized to permit venting of the correct amount of fluid from the valve catch plenum 223 that will result in an acceptable valve seating velocity for the engine valve 100 across a range of expected hydraulic fluid operating conditions. Thereafter, the process may be repeated by refilling the valve catch plenum 223 and the tappet plenum 221 with hydraulic fluid.

Figure 4:
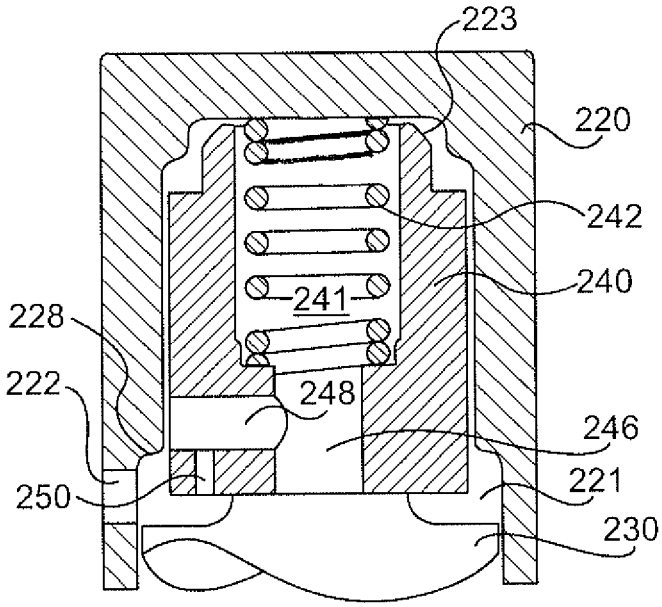
FIG. 4 is a side view in cross-section of a hydraulic lost motion system in accordance with a second embodiment of the present invention.

With reference to FIG. 4, the lost motion system 210 shown therein may include the same elements as the lost motion system shown in FIG. 3, with the following exceptions. The valve catch piston 240 in the lost motion system illustrated in FIG. 4 may include a lower end which is relatively flat through which a lower end orifice 246 extends from the hollow interior 241 through the lower end of the valve catch piston 240 wall. The lower end orifice 246 is preferably sized to be selectively blocked or occluded by the slave piston 230 when the slave piston and the valve catch piston 240 are in contact with each other. The valve catch piston 240 may further include one or more side passages 248 and one or more seating passages 250. The one or more side passages 248 may extend through the side wall of the valve catch piston 240. The one or more seating passages 250 may extend from the one or more side passages 248 through the lower end of the valve catch piston wall. The one or more side passages 248 may be located so as to be selectively occluded by the master piston shoulder 228 as a result of the valve catch piston 240 sliding in the valve catch plenum 223. The one or more seating passages 250 may be located so as to remain unoccluded by the master piston 220, and more specifically by the master piston shoulder 228, as a result of the valve catch piston 240 sliding in the valve catch plenum 223. The one or more seating passages 250 may be sized so as to permit a selective amount of hydraulic fluid to vent through them to seat the engine valve 100 after the one or more side passages 248 and the lower end orifice 246 are blocked or occluded.

The lost motion system 210 shown in FIG. 4 may be used to actuate and seat an engine valve, such as shown in FIGS. 1 and 2, in the same manner as the lost motion system shown in FIG. 3, which is described above.

Figure 5:
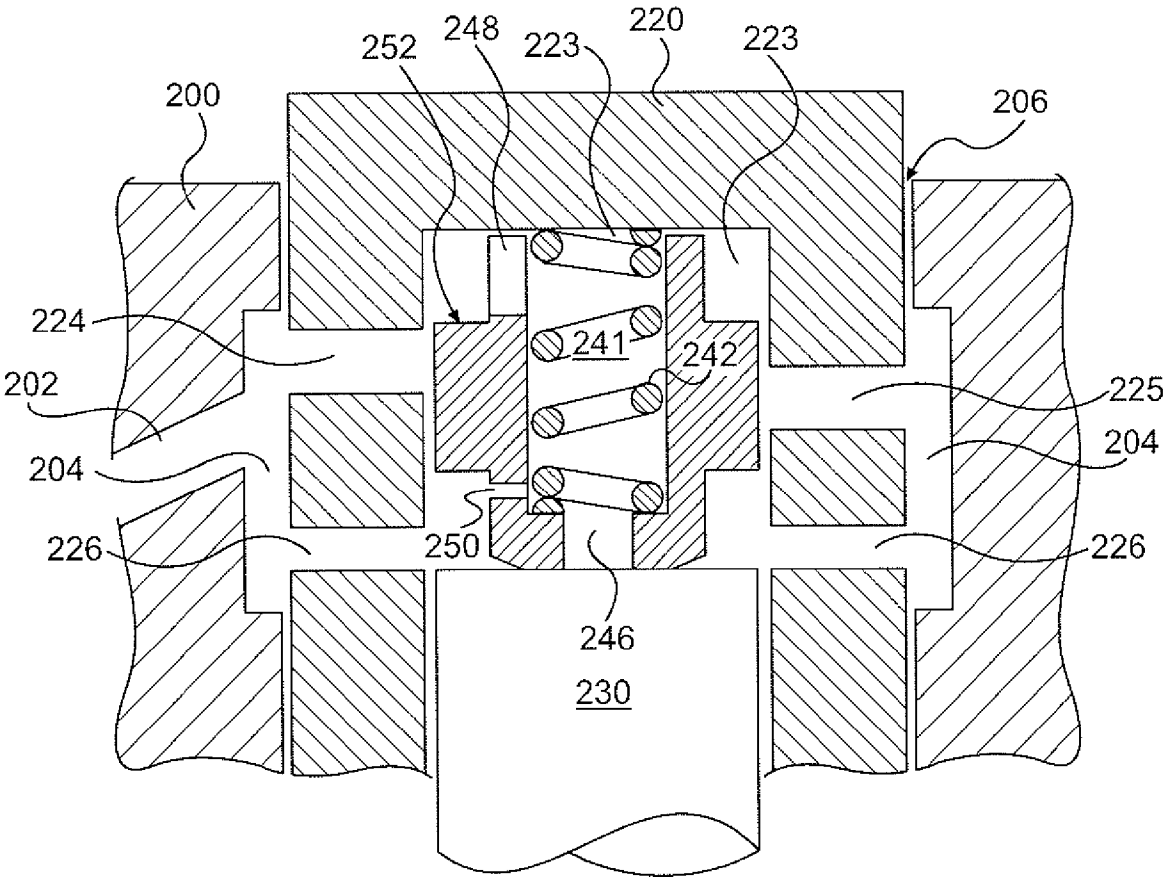
FIG. 5 is a side view in cross-section of a hydraulic lost motion system in accordance with a third embodiment of the present invention.

With reference to FIG. 5, the lost motion system 210 shown therein may include the same elements as the lost motion systems shown in FIGS. 3 and 4, with the following exceptions. With reference to FIG. 5, the lost motion system 210 may include a master piston 220 having a hollow interior comprised of an upper master piston upper bore 223 and lower master piston bore 221 which have a uniform diameter and thus do not form a master piston shoulder.

The master piston 220 may include one or more upper fluid passages 224, one or more mid fluid passages 225 and one or more lower fluid passages 226 extending from the tappet and valve catch plenums 221 and 223 to the exterior of the master piston. The upper, mid and lower fluid passages 224, 225 and 226 may be located along the side wall of the master piston 220 so as to register with an annular recess 204 provided in the housing 200 as part of the housing fluid passage 202. The annular recess 204 may be sized so as to remain in hydraulic communication with the hydraulic fluid valve 260 and the one or more upper, mid and lower fluid passages 224, 225 and 226 throughout the stroke of the master piston 220. At a minimum, the lower fluid passage 226 should be located so as to remain in hydraulic fluid communication with the annular recess 204.

The valve catch piston 240 in the lost motion system illustrated in FIG. 5 may include a lower end which is relatively flat through which a lower end orifice 246 extends from the hollow interior 241 through the lower end of the valve catch piston 240 wall. The lower end orifice 246 is preferably sized to be selectively blocked or occluded by the slave piston 230 when the slave piston and the valve catch piston 240 are in contact with each other. The valve catch piston 240 may have a stepped shape which forms a valve catch piston shoulder 252 and a valve catch piston recess 253. The valve catch piston 240 may include one or more side passages 248 located above the valve catch piston shoulder 252 and one or more seating passages 250 located along the valve catch piston recess 253. The one or more side passages 248 and the one or more seating passages may extend through the side wall of the valve catch piston 240. The one or more side passages 248 may be located so as to be selectively occluded by the valve catch piston shoulder 252 as a result of the valve catch piston 240 sliding in the valve catch plenum 223, first past the mid fluid passage 225 and thereafter past the upper fluid passage 224. The one or more seating passages 250 may be located so as to remain un-occluded by the master piston 220 as a result of the valve catch piston 240 sliding in the valve catch plenum 223. The one or more seating passages 250 may be sized so as to permit a selective amount of hydraulic fluid to vent through them to seat the engine valve 100 after the one or more side passages 248 and the lower end orifice 246 are blocked or occluded.

The lost motion system 210 shown in FIG. 5 may be used to actuate and seat an engine valve, such as shown in FIGS. 1 and 2, in the same manner as the lost motion systems shown in FIGS. 3 and 4 with the following exceptions. The valve catch piston 240 shown in FIG. 5 may throttle the flow of hydraulic fluid out of the valve catch plenum 223 by progressively occluding or blocking first the one or more mid fluid passages 225 and thereafter the one or more upper fluid passages 224. This progressive throttling of the venting of fluid from the valve catch plenum 223 may be used to progressively decrease the engine valve seating velocity over the course of the upward stroke of the valve catch piston 240.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

What is claimed is:

1. A hydraulic lost motion system for actuating an internal combustion engine valve comprising:

a housing having a housing bore extending through the housing;

a housing fluid passage extending through the housing and connecting with the housing bore;

a master piston disposed in the housing bore, said master piston having a master piston bore extending into the master piston defined by a master piston side wall;

one or more master piston fluid passages extending through the master piston side wall and connecting with the master piston bore, wherein the one or more master piston fluid passages are adapted to selectively register with the housing fluid passage;

a slave piston disposed in a lower portion of the master piston bore;

a valve catch piston disposed in an upper portion of the master piston bore, said valve catch piston having a hollow interior defined by a valve catch piston wall, a lower end orifice extending from the hollow interior through a lower end of the valve catch piston wall, one or more side passages extending through a side portion of the valve catch piston wall, and one or more seating passages extending through the valve catch piston wall, wherein the lower end orifice is located so as to be selectively occluded by the slave piston, the one or more side passages are located so that hydraulic fluid communication between the one or more side passages and the one or more master piston fluid passages is selectively occluded by the master piston side wall, and the one or more seating passages are located so as to remain in hydraulic communication with the one or more master piston fluid passages; and a valve catch spring disposed in the valve catch piston hollow interior.

2. The system of claim 1, wherein the master piston bore includes an upper master piston bore in which the valve catch piston is disposed and a lower master piston bore in which the slave piston is disposed, and wherein a diameter of the lower piston master piston bore is greater than a diameter of the upper master piston bore.

3. The system of claim 2, further comprising a slave piston spring disposed between the housing and the slave piston, said slave piston spring biasing the slave piston away from the housing.

4. The system of claim 2, wherein the one or more seating passages extend from the valve catch piston hollow interior through the valve catch piston side wall.

5. The system of claim 2, wherein at least one of the one or more seating passages extend from at least one of the one or more side passages through the lower end of the valve catch piston wall.

6. The system of claim 1, wherein the one or more master piston fluid passages include a lower master piston fluid passage and an upper master piston fluid passage, and wherein the valve catch piston wall forms a valve catch piston shoulder adapted to occlude hydraulic fluid communication between the one or more side passages and the upper master piston fluid passage.

7. The system of claim 6, wherein the one or more master piston fluid passages includes a mid master piston fluid passage disposed along the master piston side wall between the lower master piston fluid passage and the upper master piston fluid passage.

8. The system of claim 1 further comprising a hydraulic fluid control valve in hydraulic communication with the housing fluid passage.

9. The system of claim 8 further comprising a hydraulic fluid accumulator in hydraulic communication with the hydraulic fluid valve.

10. A hydraulic lost motion system for actuating an internal combustion engine valve comprising:

a housing having a housing bore extending through the housing;

a housing fluid passage extending through the housing and connecting with the housing bore;

a master piston disposed in the housing bore, said master piston having a master piston bore extending into the master piston defined by a master piston side wall;

one or more master piston fluid passages extending through the master piston side wall and connecting with the master piston bore, wherein the one or more master piston fluid passages are adapted to selectively register with the housing fluid passage;

a slave piston disposed in a lower portion of the master piston bore;

a valve catch piston disposed in an upper portion of the master piston bore, said valve catch piston having a hollow interior defined by a valve catch piston wall, a lower end orifice extending from the hollow interior through a lower end of the valve catch piston wall, one or more side passages extending through a side portion of the valve catch piston wall, and one or more seating passages extending through the valve catch piston wall, wherein the one or more side passages are located further from the lower end of the valve catch piston wall than the one or more seating passages; and a valve catch spring disposed in the valve catch piston hollow interior.

11. The system of claim 10, wherein the master piston bore includes an upper master piston bore in which the valve catch piston is disposed and a lower master piston bore in which the slave piston is disposed, and wherein a diameter of the lower piston master piston bore is greater than a diameter of the upper master piston bore.

12. The system of claim 11, further comprising a slave piston spring disposed between the housing and the slave piston, said slave piston spring biasing the slave piston away from the housing.

13. The system of claim 11, wherein the one or more seating passages extend from the valve catch piston hollow interior through the valve catch piston side wall.

14. The system of claim 11, wherein at least one of the one or more seating passages extend from at least one of the one or more side passages through the lower end of the valve catch piston wall.

15. The system of claim 10, wherein the one or more master piston fluid passages include a lower master piston fluid passage and an upper master piston fluid passage, and wherein the valve catch piston wall forms a valve catch piston shoulder adapted to occlude hydraulic fluid communication between the one or more side passages and the upper master piston fluid passage.

16. The system of claim 15, wherein the one or more master piston fluid passages includes a mid master piston fluid passage disposed along the master piston side wall between the lower master piston fluid passage and the upper master piston fluid passage.

17. The system of claim 10 further comprising a hydraulic fluid control valve in hydraulic communication with the housing fluid passage.

18. The system of claim 17 further comprising a hydraulic fluid accumulator in hydraulic communication with the hydraulic fluid valve.

* * * * *